US011458410B2

(12) United States Patent
Xu

(10) Patent No.: US 11,458,410 B2
(45) Date of Patent: Oct. 4, 2022

(54) ALL DIMENSIONS FREE CONNECTION MAGNETIC BUILDING BLOCK

(71) Applicant: HANGZHOU STRONG MAGNET & ASSEMBLY CO., LTD., Hangzhou (CN)

(72) Inventor: Huiyang Xu, Hangzhou (CN)

( * ) Notice: Subject to any disclaimer, the term of this patent is extended or adjusted under 35 U.S.C. 154(b) by 0 days.

(21) Appl. No.: 16/895,935

(22) Filed: Jun. 8, 2020

(65) Prior Publication Data

US 2021/0322891 A1 Oct. 21, 2021

(30) Foreign Application Priority Data

Apr. 15, 2020 (CN) ..... 202010294950.5

(51) Int. Cl.
*A63H 33/04* (2006.01)
*A63H 33/26* (2006.01)
*A63H 33/06* (2006.01)

(52) U.S. Cl.
CPC ..... *A63H 33/046* (2013.01); *A63H 33/06* (2013.01); *A63H 33/26* (2013.01); *A63H 33/044* (2013.01)

(58) Field of Classification Search
CPC .... A63H 33/046; A63H 33/26; A63H 33/044; A63H 33/06
USPC ..... 446/85, 92, 129, 131, 137, 138
See application file for complete search history.

(56) References Cited

U.S. PATENT DOCUMENTS 2,872,754 A * 2/1959 Cronberger ..... A63H 33/046 446/92
2,939,243 A * 6/1960 Duggar ..... A63H 33/046 446/92
2,970,388 A * 2/1961 Yonkers ..... A63H 33/046 403/171
3,254,440 A * 6/1966 Duggar ..... A63H 33/046 446/92
3,601,921 A * 8/1971 Strohmaier ..... A63H 33/046 446/92
5,347,253 A * 9/1994 Ogikubo ..... A63F 9/34 446/92
5,409,236 A * 4/1995 Therrien ..... A63F 9/1204 273/156
5,520,396 A * 5/1996 Therrien ..... A63F 9/34 273/156
5,746,638 A * 5/1998 Shiraishi ..... A63H 33/046 446/131
6,024,626 A * 2/2000 Mendelsohn ..... A63H 33/046 446/124
6,431,936 B1 * 8/2002 Kiribuchi ..... A63H 33/046 446/92
6,749,480 B1 * 6/2004 Hunts ..... A63H 33/046 446/85

(Continued)

*Primary Examiner* — Alexander R Niconovich

(57) ABSTRACT

The present disclosure provides a magnetic building block for connecting with other magnetic building block. The magnetic building block includes a base, a cover, at least one horizontal magnet and at least one vertical magnet. The base includes at least two vertical accommodating grooves and at least one horizontal accommodating groove. The cover is configured to connect with the base and cover the at least two vertical accommodating grooves and the at least one horizontal accommodate groove. The at least one horizontal magnet is located at the at least one horizontal accommodating groove. The at least two vertical magnets are located at the at least two vertical accommodating grooves respectively. Magnetic pole directions of two adjacent vertical magnets of the at least two vertical magnets are opposite to each other.

13 Claims, 7 Drawing Sheets

(56) References Cited

U.S. PATENT DOCUMENTS 6,969,294 B2 * 11/2005 Vicentelli ..... G09F 7/04 446/92
7,038,567 B2 * 5/2006 Vicentelli ..... G09B 1/38 446/92
7,154,363 B2 * 12/2006 Hunts ..... H01F 7/0242 446/92
7,160,170 B2 * 1/2007 Yoon ..... A63H 33/046 273/156
7,320,633 B2 * 1/2008 Park ..... A63H 33/046 446/131
7,413,493 B2 * 8/2008 Toht ..... A63H 33/046 446/131
7,887,056 B2 * 2/2011 Tenorio ..... A63F 9/1208 273/156
7,963,818 B2 * 6/2011 Fullerton ..... A63H 33/046 446/93
7,985,116 B2 * 7/2011 Song ..... A63H 33/046 446/92
8,850,683 B2 * 10/2014 Haughey ..... A63H 33/046 446/124
9,022,829 B2 * 5/2015 Rosen ..... A63H 33/046 446/131
9,433,871 B2 * 9/2016 Park ..... A63H 33/102
9,636,600 B2 * 5/2017 Rudisill ..... A63H 33/046
9,643,100 B2 * 5/2017 Fein ..... A63H 33/046
9,713,777 B2 * 7/2017 Peterson ..... B29C 65/56
9,751,025 B2 * 9/2017 Kiribuchi ..... A63H 33/046
9,782,687 B2 * 10/2017 Bagley ..... A63H 33/046
9,814,998 B2 * 11/2017 Wei ..... A63H 33/046
9,873,062 B2 * 1/2018 Purns ..... A63H 33/06
10,722,809 B1 * 7/2020 Park ..... A63H 33/046
11,077,385 B2 * 8/2021 Kogure ..... A63H 33/26
11,103,801 B2 * 8/2021 Vicentelli ..... A63H 33/06
2006/0240737 A1 * 10/2006 Yoon ..... A63H 33/046 446/92
2007/0287353 A1 * 12/2007 Vicentelli ..... A63H 33/046 446/92
2008/0200091 A1 * 8/2008 Blaivas ..... A63H 33/12 446/122
2010/0022158 A1 * 1/2010 Kim ..... A63H 33/046 446/92
2010/0056013 A1 * 3/2010 Kaplan ..... A63H 33/046 446/92
2010/0087119 A1 * 4/2010 Vicentelli ..... A63H 33/046 446/92
2010/0120322 A1 * 5/2010 Vicentelli ..... A63H 33/046 446/92
2012/0309259 A1 * 12/2012 Mak ..... A63H 33/046 446/92
2014/0213139 A1 * 7/2014 Ferguson ..... A63H 33/046 446/92
2014/0302741 A1 * 10/2014 Whittaker ..... A63H 33/046 446/92
2015/0065007 A1 * 3/2015 Klepper ..... A63H 33/046 446/92
2018/0056204 A1 * 3/2018 Knudsen ..... A63H 33/046
2018/0056206 A1 * 3/2018 Micko ..... A63H 33/046
2019/0054388 A1 * 2/2019 Cranias ..... A63H 33/06

* cited by examiner

ALL DIMENSIONS FREE CONNECTION MAGNETIC BUILDING BLOCK

FIELD OF THE INVENTION

The present disclosure relates to the field of building blocks for use as toys, and specifically to a magnetic building block having magnets inside to form all dimensions free magnetic connection between the blocks.

BACKGROUND OF THE INVENTION

In the toy family, magnetic building blocks can be freely combined into different forms having different structures, which can develop children's practical ability and thinking ability, and which are therefore popular with children. However, most of existing magnetic building blocks cannot be combined in two or all dimensions, that is end surfaces of vertical magnets of two adjacent blocks cannot be absorbed to or combined with each other, and side surfaces of horizontal magnets of two adjacent blocks cannot be absorbed to or combined with each other, which brings about inconveniences to children and tends to reduce the user experience.

SUMMARY OF THE INVENTION

In order to overcome the disadvantage of the existing magnetic building blocks, the present disclosure provides a magnetic building block having magnets inside to form universal magnetic connection between the blocks, which has a good user experience and reasonable design.

The present disclosure adopts the following technical solution: a magnetic building block for connecting with other magnetic building block including a base including at least two vertical accommodate grooves and at least one horizontal accommodate groove; a cover configured to connect with the base and cover the at least two vertical accommodate grooves and the at least one horizontal accommodate groove; at least one horizontal magnet located at the at least one horizontal accommodate groove; and at least two vertical magnets located at the at least two vertical accommodate grooves respectively, magnetic pole directions of two adjacent vertical magnets of the at least two vertical magnets being opposite to each other.

Further, the at least two vertical magnets include a plurality of vertical magnets, the at least two vertical accommodate grooves includes a plurality of vertical accommodate grooves, the plurality of vertical magnets and the plurality of vertical accommodate grooves have equal number, the at least one horizontal magnet includes a plurality of horizontal magnets, the at least one horizontal accommodate grooves includes a plurality of horizontal accommodate grooves, and the plurality of horizontal magnets and the plurality of horizontal accommodate grooves have equal number.

Further, the plurality of vertical magnets are located at the plurality of vertical accommodate grooves respectively, the magnetic pole direction of each vertical magnet is the same as a length direction of the vertical magnet, and the magnetic pole direction of each vertical magnet is the same as a length direction of the vertical magnet and is opposite to the magnetic pole direction of the adjacent vertical magnet.

Further, the horizontal magnet defines a length direction and a thickness direction, the horizontal magnet is disposed at the horizontal accommodate groove along the thickness direction of the horizontal magnet, and the horizontal magnet is able to rotate around a virtual axis along the length direction of the horizontal magnet.

Further, a cross-section shape of the base is selected from the group of a rectangular shape, a square shape, and a triangle shape, and the cover has a shape corresponding to the cross-section shape of the base.

Further, an intersection angle between a length direction of the vertical magnet and a length direction of the horizontal magnet is 90 degrees.

Further, the at least two vertical magnets and the at least one horizontal magnet are disposed alternately.

Further, the magnetic pole direction of the vertical magnet is from a south pole of the vertical magnet to a north pole of the vertical magnet and is same as a direction from a top end of the vertical magnet to a bottom end of the vertical magnet, the magnetic pole direction of the adjacent vertical magnet is from a south pole of the adjacent vertical magnet to a north pole of the adjacent vertical magnet and is same as a direction from a bottom end of the adjacent vertical magnet to a top end of the adjacent vertical magnet.

Further, poles of the at least two vertical magnets in the same horizontal plane are arranged in a selected manner from a first manner and a second manner, the first manner being a north pole, a south pole, a north pole to a south pole, and the second manner being a south pole, a north pole, a south pole to a north pole.

Further, the magnetic pole direction of the vertical magnet is along a length direction of the vertical magnet, and the magnetic pole direction of the horizontal magnet is along a thickness direction of the horizontal magnet.

The present disclosure also adopts the following technical solution: a magnetic building block for connecting with other magnetic building block including a base comprising at least one accommodate groove a cover configured to connect with the base and cover the at least one accommodate groove; at least two first magnets fixed at the at least one accommodate groove, magnetic pole directions of two adjacent first magnets of the at least two first magnets being opposite to each other, and at least one second magnet located at the at least one accommodate groove.

Further, the at least two first magnets includes a plurality of first magnets, the at least one second magnet includes a plurality of second magnets, the at least one accommodate grooves includes a plurality of accommodate grooves, the plurality of horizontal magnets and the plurality of accommodate grooves have equal number, and the plurality of second magnets are located at the plurality of accommodate grooves respectively.

Further, the magnetic pole direction of each first magnet is the same as a length direction of the first magnet, and the magnetic pole direction of each first magnet is the same as a length direction of the first magnet and is opposite to the magnetic pole direction of the adjacent first magnet.

Further, the second magnet defines a length direction and a thickness direction, the second magnet is disposed at the accommodate groove along the thickness direction of the second magnet, and the second magnet is able to rotate around a virtual axis along the length direction of the second magnet.

Further, a cross-section shape of the base is selected from the group of a rectangular shape, a square shape, and a triangle shape, and the cover has a shape corresponding to the cross-section shape of the base.

Further, an intersection angle between a length direction of the first magnet and a length direction of the second magnet is 90 degrees.

Further, the at least two first magnets and the at least one second magnet are disposed alternately.

Further, the magnetic pole direction of the first magnet is from a south pole of the first magnet to a north pole of the first magnet and is same as a direction from a top end of the first magnet to a bottom end of the first magnet, the magnetic pole direction of the adjacent first magnet is from a south pole of the adjacent first magnet to a north pole of the adjacent first magnet and is same as a direction from a bottom end of the adjacent first magnet to a top end of the adjacent first magnet.

Further, poles of the at least two first magnets in the same plane vertical to a length direction of the at least two first magnets are arranged in a selected manner from a first manner and a second manner, the first manner being a north pole, a south pole, a north pole to a south pole, and the second manner being a south pole, a north pole, a south pole to a north pole.

Further, the magnetic pole direction of the first magnet is along a length direction of the first magnet, and the magnetic pole direction of the second magnet is along a thickness direction of the second magnet.

The present disclosure also has the beneficial effects: magnetic pole directions of two adjacent first magnets are opposite to each other, poles of the at least two first magnets in the same plane are arranged in a selected manner from the first manner and the second manner, such that all of the magnetic building blocks are arranged regularly. Further, the poles of the first magnets of the magnetic building block with the first manner can be connected with the poles of the first magnets of the adjacent magnetic building block with the second manner in the vertical direction, and the second magnet of the magnetic building block may freely rotate so as to connect with the second magnet of the adjacent magnetic building block in the horizontal direction. Thus, two adjacent blocks can be connected with each other easily in the vertical direction and the horizontal direction, which brings conveniences to children, improves the user experience and has reasonable design.

BRIEF DESCRIPTION OF THE DRAWINGS

For the purpose of a clearer description of the embodiments in this application or technical solutions in prior art, below is a brief introduction of the attached drawings needed to be used in the description of the embodiments or prior art. Apparently, the attached drawings in the following description are only some embodiments indicated in the present application. For ordinary skill in the art, they may obtain other drawings according to these attached drawings without any innovative laboring.

The present disclosure will be further described with reference to the attached drawings and the embodiments hereunder.

DETAILED DESCRIPTION OF THE ILLUSTRATED EMBODIMENTS

In order to provide a clear understanding of the objects, features, and advantages of the embodiments, the following are detailed and complete descriptions to the technological solutions adopted in the embodiments. Obviously, the descriptions are part of the whole embodiments. The other embodiments which are not processed creatively by technicians of ordinary skills in the field are under the protection of this disclosure. The same is given with reference to the drawings and specific embodiments. It should be noted that non-conflicting embodiments in the disclosure and the features in the embodiments may be combined with each other without conflict.

In the following description, numerous specific details are set forth in order to provide a full understanding of the disclosure. The disclosure may be practiced otherwise than as described herein. The following specific embodiments are not to limit the scope of the disclosure.

Unless defined otherwise, all technical and scientific terms herein have the same meaning as used in the field of the art as generally understood. The terms used in the disclosure are to describe particular embodiments and are not intended to limit the disclosure.

The disclosure, referencing the accompanying drawings, is illustrated by way of examples and not by way of limitation. It should be noted that references to "an" or "one" embodiment in this disclosure are not necessarily to the same embodiment, and such references mean "at least one."

Figure 1:
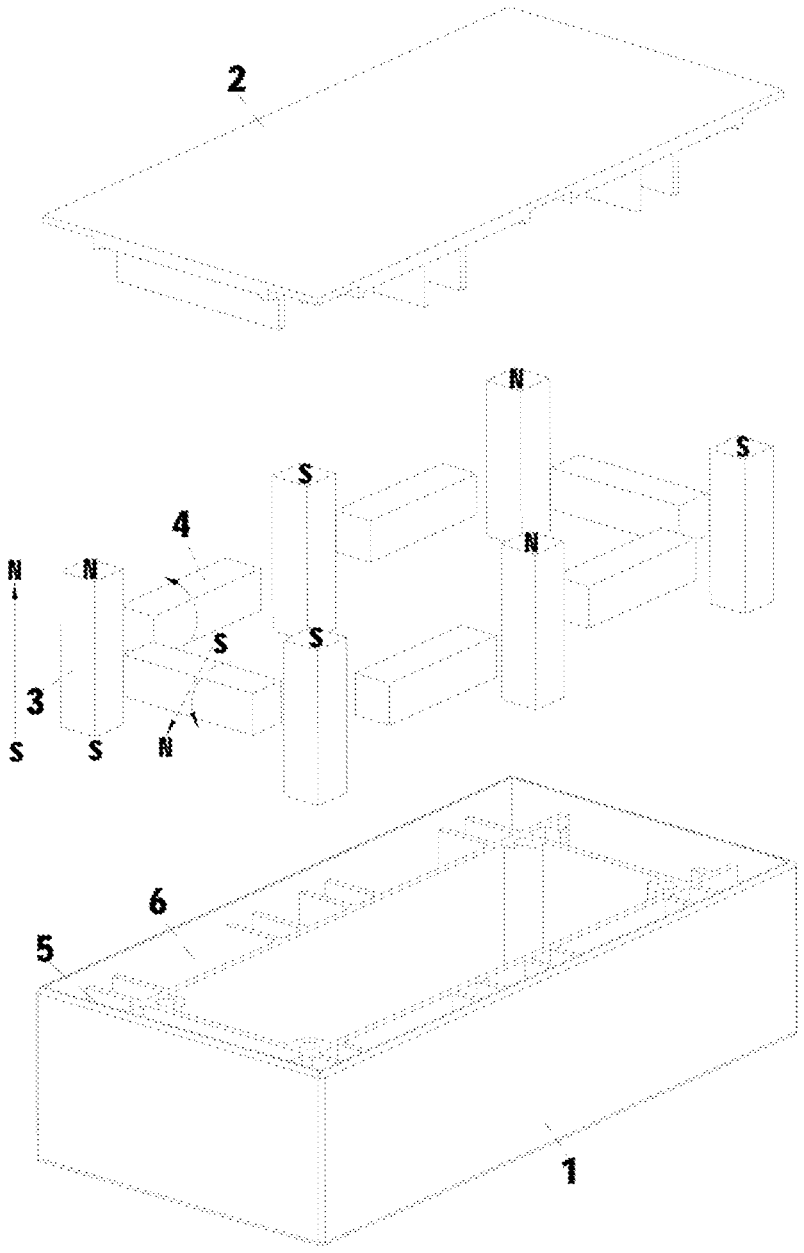
FIG. 1 is an exploded view of a magnetic building block according to a first embodiment of the present disclosure.
Figure 2:
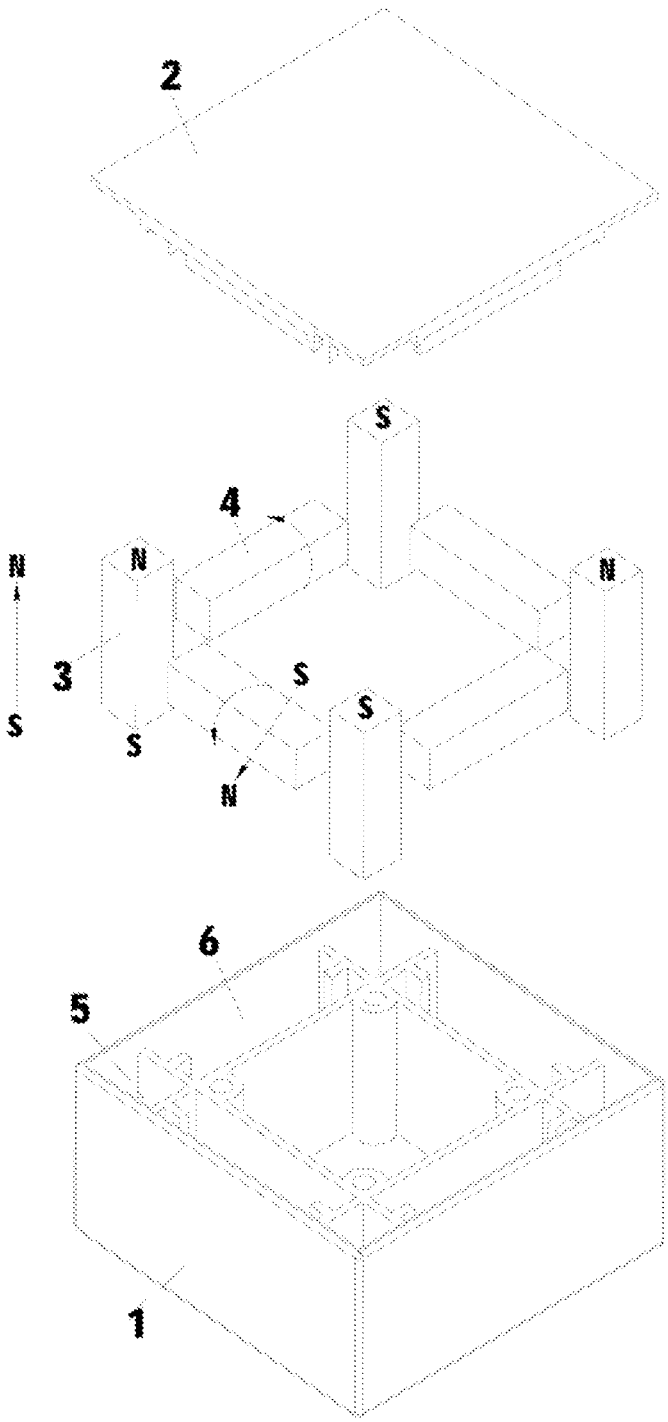
FIG. 2 is an exploded view of a magnetic building block according to a second embodiment of the present disclosure.
Figure 3:
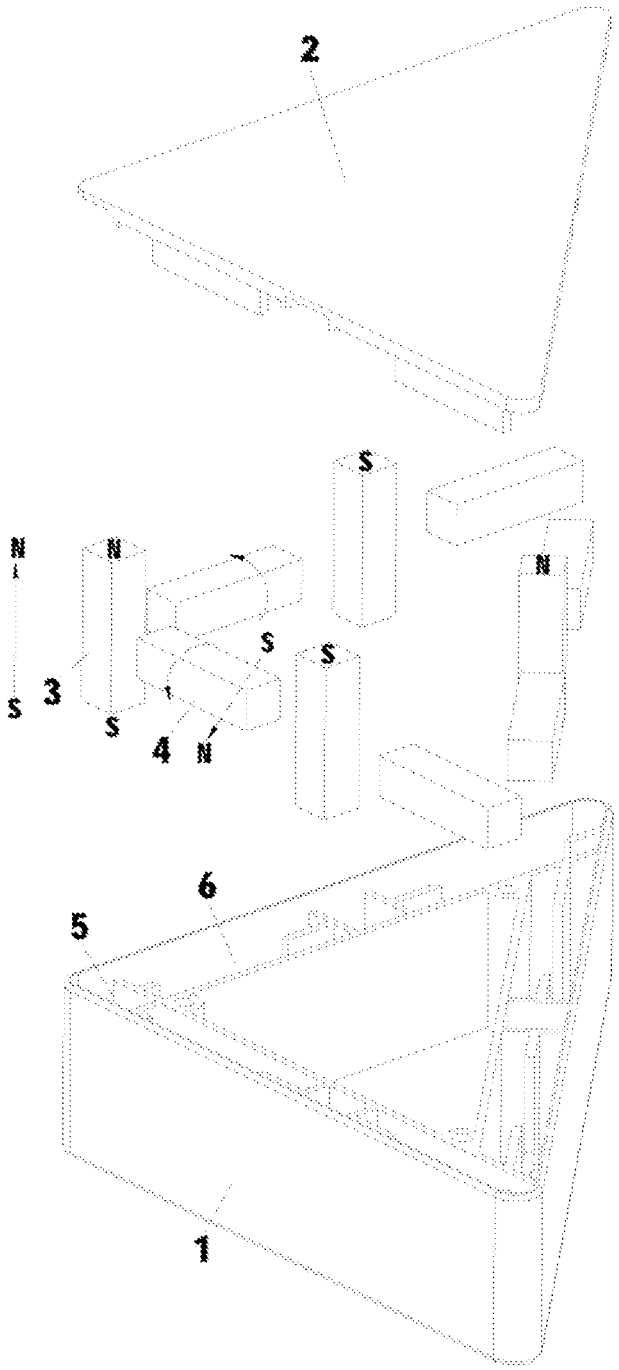
FIG. 3 is an exploded view of a magnetic building block according to a third embodiment of the present disclosure.
Figure 4:
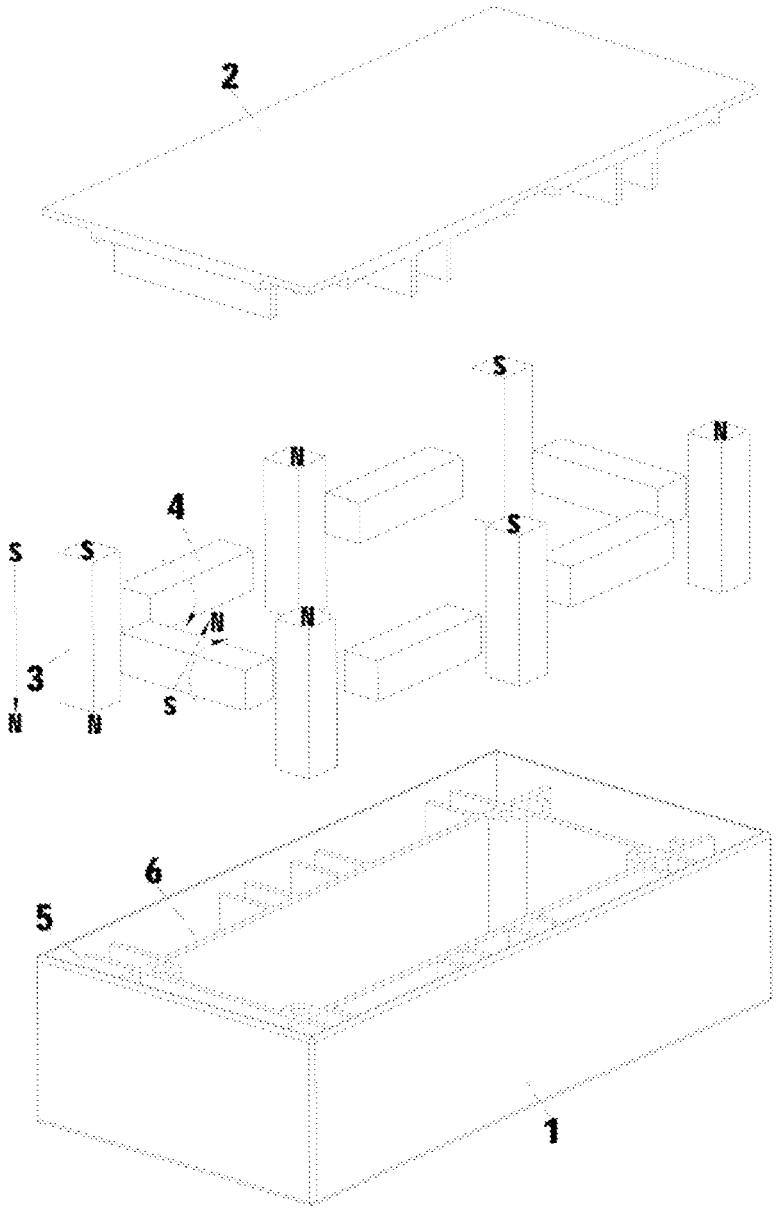
FIG. 4 is an exploded view of a magnetic building block according to a fourth embodiment of the present disclosure.
Figure 5:
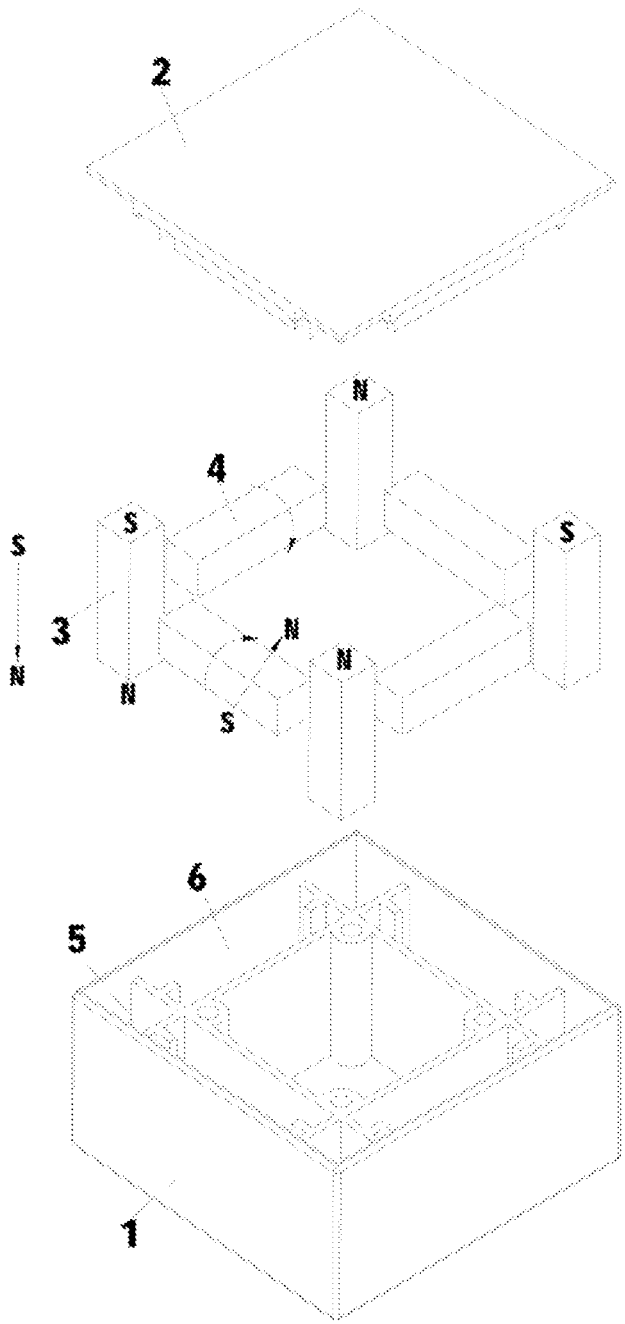
FIG. 5 is an exploded view of a magnetic building block according to a fifth embodiment of the present disclosure.
Figure 6:
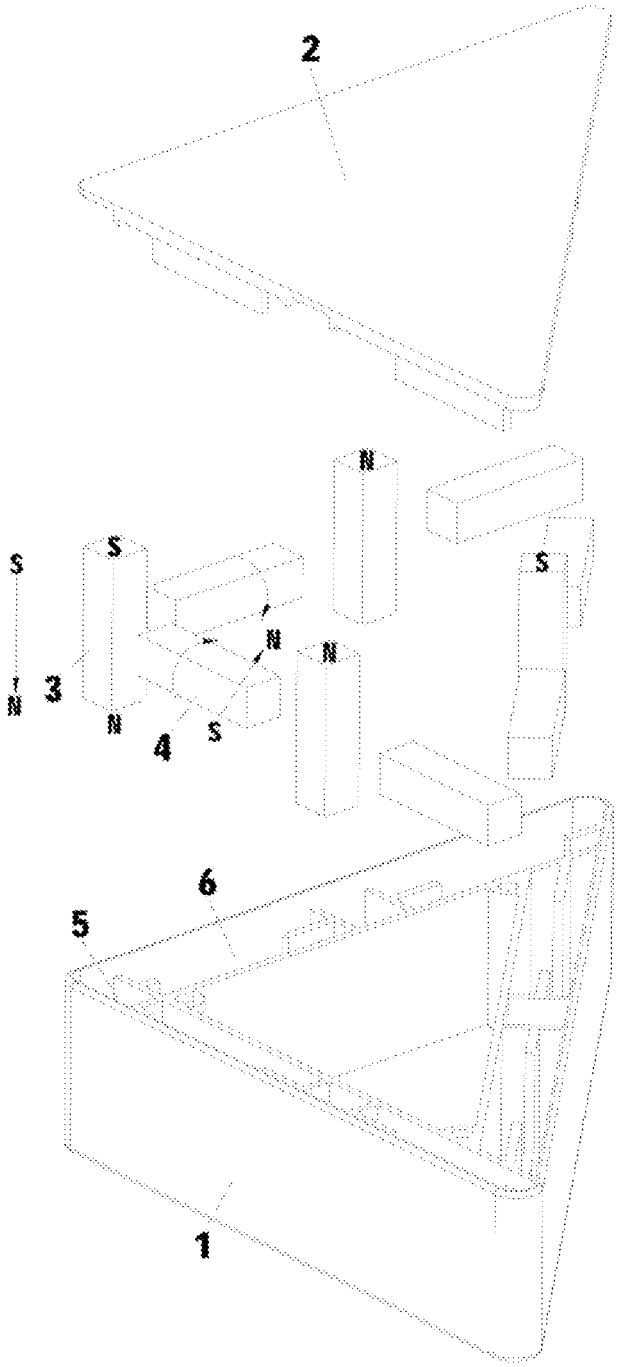
FIG. 6 is an exploded view of a magnetic building block according to a sixth embodiment of the present disclosure.
Figure 7:
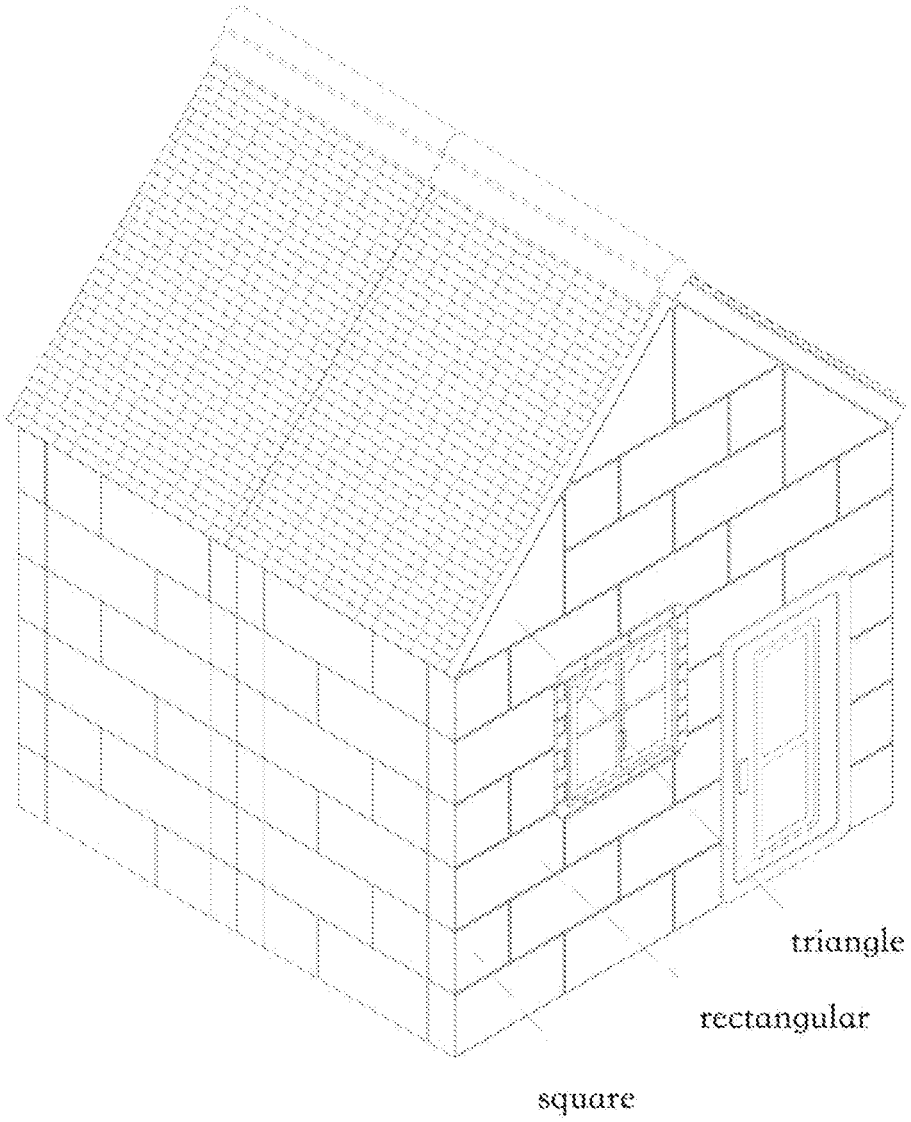
FIG. 7 is a schematic diagram of a plurality of magnetic building blocks according to above embodiments of the present disclosure connected with each other to build a toy house.

FIG. 1-FIG. 6 show magnetic building blocks according to embodiments of the present disclosure and toy house build by the magnetic building blocks, and FIG. 7 shows a schematic diagram of a plurality of magnetic building blocks according to above embodiments of the present disclosure connected with each other to build a toy house. The magnetic building block for connecting with other magnetic building block includes a base having at least two vertical accommodate grooves 5 and at least one horizontal accommodate groove 6, a cover 2 configured to connect with the base 1 and cover the at least two vertical accommodate grooves 5 and the at least one horizontal accommodate groove 6, at least one horizontal magnet 4 located at the at least one horizontal accommodate groove 6, and at least two vertical magnets 3 located at the at least two vertical accommodate grooves 5. Magnetic pole directions of two adjacent vertical magnets 3 of the at least two vertical magnets 3 are opposite to each other.

In the embodiments, the magnetic building block includes a plurality of vertical magnets 3 and a plurality of horizontal magnets 4. The base 1 includes a plurality of vertical accommodate grooves 5 and a plurality of horizontal accommodate grooves 6. The plurality of vertical magnets 3 and the plurality of vertical accommodate grooves 5 have equal number. The plurality of horizontal magnets 4 and the plurality of horizontal accommodate grooves 6 have equal number.

In the embodiments, the plurality of vertical magnets 3 are located at the plurality of vertical accommodate grooves 5 respectively. The magnetic pole direction of each vertical magnet 3 is the same as a length direction of the vertical magnet 3. The magnetic pole direction of each vertical magnet 3 is the same as a length direction of the vertical magnet 3 and is opposite to the magnetic pole direction of the adjacent vertical magnet 3.

In the embodiments, the horizontal magnet 4 defines a length direction and a thickness direction. The horizontal magnet 4 is disposed at the horizontal accommodate groove 6 along the thickness direction. The horizontal magnet 4 is able to rotate around a virtual axis along the length direction of the horizontal magnet 4.

In the embodiments, a cross-section shape of the base 1 along the horizontal plane is selected from the group of a rectangular shape, a square shape, and a triangle shape, and the cover 2 has a shape corresponding to the cross-section shape of the base 1.

In the embodiments, an intersection angle between a length direction of the vertical magnet 3 and a length direction of the horizontal magnet 4 can be 90 degree or other degree. The vertical magnets 3 and the horizontal magnet 4 are disposed alternately, and there is at least one horizontal magnet 4 disposed between two adjacent vertical magnets 4. Further, poles of the at least two vertical magnets 3 in the same horizontal plane are arranged in a first manner or a second manner. The first manner is a north pole, a south pole, a north pole to a south pole (that is N-S-N-S), and the second manner is a south pole, a north pole, a south pole to a north pole (that is S-N-S-N).

In the embodiments, the magnetic pole direction of the vertical magnet 3 is from a south pole of the vertical magnet 3 to a north pole of the vertical magnet 3 (that is S-N) and is same as a direction from a top end of the vertical magnet 3 to a bottom end of the vertical magnet 3. The magnetic pole direction of the adjacent vertical magnet 3 is from a south pole of the adjacent vertical magnet 3 to a north pole of the adjacent vertical magnet 3 and is same as a direction from a bottom end of the adjacent vertical magnet 3 to a top end of the adjacent vertical magnet 3. Furthermore, the magnetic pole direction of the vertical magnet 3 is along a length direction of the vertical magnet 3, and the magnetic pole direction of the horizontal magnet 4 is along the thickness direction of the horizontal magnet 4.

The present disclosure has the beneficial effects: magnetic pole directions of two adjacent vertical magnets 3 are opposite to each other, poles of the at least two vertical magnets 3 in the same horizontal plane are arranged in a selected manner from the first manner (N-S-N-S) and the second manner (S-N-S-N), such that all of the magnetic building blocks are arranged regularly. In addition, the poles of the vertical magnets 3 of the magnetic building block with the first manner can be connected with the poles of the vertical magnets 3 of the adjacent magnetic building block with the second manner in the vertical direction, and the horizontal magnet 4 of the magnetic building block may freely rotate so as to connect with the horizontal magnet 4 of the adjacent magnetic building block 4 in the horizontal direction.

As mentioned, in the above magnetic building block of present disclosure, the vertical magnets 3 of the magnetic building block can be connected with the poles of the vertical magnets 3 of the adjacent magnetic building block in the vertical direction, and the horizontal magnet 4 of the magnetic building block may freely rotate so as to connect with the horizontal magnet of the adjacent magnetic building block 4 in the horizontal direction. Thus, two adjacent blocks can be connected with each other easily in the vertical direction and the horizontal direction, which brings conveniences to children and improves the user experience, and has reasonable design.

It can be understood, if the vertical magnets 3 of one magnetic building block are arranged in a first manner of N-S-N-S, the vertical magnets 3 of other magnetic building block should be arranged in first manner of N-S-N-S such that two adjacent magnetic building block can have opposites attract, otherwise two adjacent magnetic building block will repel each other.

Finally, it should be noted that above embodiments are merely used for illustrating the technical solutions of the disclosure, rather than limiting the disclosure; though the disclosure is illustrated in detail with reference to the aforementioned embodiments, it should be understood by those of ordinary skill in the art that modifications may still be made on the technical solutions disclosed in the aforementioned respective embodiments, or equivalent substitutions may be made to a part of technical features thereof; and these modifications or substitutions do not make the essence of the corresponding technical solutions depart from the spirit and scope of the technical solutions of the respective embodiments of the disclosure.

What is claimed is:

1. A magnetic building block, comprising a polyhedron, for connecting with another magnetic building block, which is also a polyhedron, comprising:

a base comprising a polyhedron comprising at least three sides connected together so as to define at least three corners having at least three angles therebetween, at least one vertical accommodating groove defined within at least one of said at least three corners of said polyhedron, at least one vertical accommodating groove defined within at least one of said at least three sides of said polyhedron, and at least one horizontal accommodating groove;

a cover configured to connect with said base and thereby cover said at least one vertical accommodating groove defined within said at least one of said at least three corners of said polyhedron, said at least one vertical accommodating groove defined within at least one of said at least three sides of said polyhedron, and said at least one horizontal accommodating groove;

at least one horizontal magnet disposed within said at least one horizontal accommodating groove and having opposite pole directions; and at least two vertical magnets respectively disposed within said at least one vertical accommodating groove defined within said at least one of said at least three corners of said polyhedron and within said at least one vertical accommodating grooves defined within said at least one of said at least three sides of said polyhedron, respectively having opposite magnetic pole directions, and wherein said magnetic pole directions of two adjacent vertical magnets of said at least two vertical magnets are opposite to each other.

2. The magnetic building block according to claim 1, wherein:

said at least one horizontal magnet comprises a plurality of horizontal magnets, said at least one horizontal accommodating groove comprises a plurality of horizontal accommodating grooves, and said plurality of horizontal magnets and said plurality of horizontal accommodating grooves are equal in number.

3. The magnetic building block according to claim 1, wherein:

said magnetic pole direction of each one of said at least two vertical magnets is the same as a length dimension of each one of said at least two vertical magnets.

4. The magnetic building block according to claim 1, wherein:

said at least one horizontal magnet has a predetermined length dimension and a predetermined thickness dimension; and said at least one horizontal magnet is able to rotate around a virtual axis extending along said length dimension of said at least one horizontal magnet.

5. The magnetic building block according to claim 1, wherein:

said base has a cross-sectional configuration which is selected from the group comprising a rectangular shape, a square shape, and a triangular shape, and said cover has a cross-sectional shape corresponding to said cross-sectional shape of said base.

6. The magnetic building block according to claim 1, wherein:

said magnetic pole direction of one of said at least two vertical magnets is from a north pole of said one of said at least two vertical magnets to a south pole of said one of said at least two vertical magnets and is the same as a direction extending from a top end of said one of said at least two vertical magnets to a bottom end of said one of said at least three vertical magnets, and said magnetic pole direction of an adjacent one of said at least two vertical magnets is from a south pole of said adjacent one of said at least two vertical magnets to a north pole of said adjacent one of said at least two vertical magnets and is the same as a direction extending from a top end of said adjacent one of said at least two vertical magnets to a bottom end of said adjacent one of said at least two vertical magnets.

7. The magnetic building block according to claim 1, wherein:

said magnetic poles of said at least two vertical magnets, disposed within vertical planes, are arranged in a manner selected from first and second manners with said magnetic poles of adjacent vertical magnets alternating polarity such that said first manner comprises a north pole, a south pole, a north pole, and a south pole, and said second manner being a south pole, a north pole, a south pole, and a north pole.

8. The magnetic building block according to claim 1, wherein:

said magnetic pole direction of each one of said at least two vertical magnets is along a length dimension of each one of said at least two vertical magnets, and said magnetic pole direction of said at least one horizontal magnet is along a thickness dimension of said at least one horizontal magnet.

9. A magnetic building block, comprising a polyhedron, for connecting with another magnetic building block, which is also a polyhedron, comprising:

a base comprising a polyhedron comprising four sides connected together so as to define four corners having four angles therebetween, a vertical accommodating groove defined within each one of said four corners of said polyhedron, and a horizontal accommodating groove defined within each one of said four sides of said polyhedron;

a cover configured to connect with said base and thereby cover said four vertical accommodating grooves defined within said four corners of said polyhedron and said four horizontal accommodating grooves defined within said four sides of said polyhedron;

a horizontal magnet disposed within each one of said four horizontal accommodating grooves defined within said four sides of said polyhedron and having opposite pole directions; and four vertical magnets respectively disposed within said four vertical accommodating grooves defined within said four corners of said polyhedron, respectively having opposite magnetic pole directions, and wherein said magnetic pole directions of two adjacent vertical magnets of said at least two vertical magnets are opposite to each other.

10. The magnetic building block as set forth in claim 9, wherein:

said base and said cover together comprise a cube.

11. A magnetic building block, comprising a polyhedron, for connecting with another magnetic building block, which is also a polyhedron, comprising:

a base comprising a polyhedron comprising four sides connected together so as to define four corners having four angles therebetween, a vertical accommodating groove defined within each one of said four corners of said polyhedron, a pair of vertical accommodating grooves defined within two opposite sides of said polyhedron, and at least one horizontal accommodating groove defined within each one of said four sides of said polyhedron;

a cover configured to connect with said base and thereby cover said four vertical accommodating grooves defined within said four corners of said polyhedron, said pair of vertical accommodating grooves defined within two opposite sides of said polyhedron, and said at least one horizontal accommodating groove defined within each one of said four sides of said polyhedron;

a horizontal magnet disposed within all of said horizontal accommodating grooves defined within each one of said four sides of said polyhedron, and having opposite pole directions; and four vertical magnets respectively disposed within said four vertical accommodating grooves defined within said four corners of said polyhedron, and respectively having opposite magnetic pole directions, a pair of vertical magnets respectively disposed within said pair of vertical accommodating grooves defined within said two opposite sides of said polyhedron, and respectively having opposite magnetic pole directions, and wherein said magnetic pole directions of two adjacent vertical magnets of all of said vertical magnets are opposite to each other.

12. The magnetic building block as set forth in claim 11, wherein:

said base and said cover together comprise a rectangular parallepiped.

13. The magnetic building block as set forth in claim 12, wherein:

said pair of vertical magnets respectively disposed within said pair of vertical accommodating grooves defined within said two opposite sides of said polyhedron are disposed within longer sides of said rectangular parallepiped.

* * * * *